US012465802B2

(12) United States Patent
Sorin

(10) Patent No.: US 12,465,802 B2
(45) Date of Patent: Nov. 11, 2025

(54) HANG ROW PENDULUM APPARATUS AND METHODS OF USING SAME

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 17/718,800

(22) Filed: Apr. 12, 2022

(65) Prior Publication Data

US 2022/0323816 A1 Oct. 13, 2022

Related U.S. Application Data

(63) Continuation-in-part of application No. 17/245,189, filed on Apr. 30, 2021, now Pat. No. 11,712,596.

(60) Provisional application No. 63/173,578, filed on Apr. 12, 2021.

(51) Int. Cl.
*A63B 21/06* (2006.01)
*A63B 21/00* (2006.01)
*A63B 21/072* (2006.01)

(52) U.S. Cl.
CPC ..... *A63B 21/0615* (2013.01); *A63B 21/0724* (2013.01); *A63B 21/0728* (2013.01); *A63B 21/4035* (2015.10); *A63B 21/4039* (2015.10); *A63B 2208/0257* (2013.01); *A63B 2208/0285* (2013.01)

(58) Field of Classification Search
CPC ..... A63B 21/0615; A63B 21/0724; A63B 21/0728; A63B 21/4035; A63B 21/4039; A63B 2208/0257; A63B 2208/0285; A63B 17/04
See application file for complete search history.

(56) References Cited

U.S. PATENT DOCUMENTS

| | | | | |
|---|---|---|---|---|
| 4,072,309 | A * | 2/1978 | Wilson | A63B 21/0615 482/130 |
| 4,856,773 | A | 8/1989 | Deola | |
| 5,141,480 | A | 8/1992 | Lennox et al. | |
| 5,277,684 | A | 1/1994 | Harris | |
| 5,688,216 | A | 11/1997 | Mauriello | |
| 5,954,619 | A | 9/1999 | Petrone | |
| 6,482,139 | B1 * | 11/2002 | Haag | A63B 21/078 482/121 |
| 7,575,538 | B1 | 8/2009 | Clark | |
| 7,753,830 | B1 * | 7/2010 | Marsh | A63B 23/03525 482/142 |
| 10,016,646 | B2 | 7/2018 | Butler | |
| D898,137 | S | 10/2020 | Carmichael et al. | |
| 10,850,153 | B1 | 12/2020 | Sorin | |
| D931,389 | S | 9/2021 | Dunahay et al. | |
| 11,173,337 | B2 * | 11/2021 | Jones | A63B 21/06 |
| 11,260,261 | B2 | 3/2022 | Henniger et al. | |
| D948,641 | S | 4/2022 | Henniger et al. | |
| D1,023,180 | S * | 4/2024 | Li | D21/673 |
| 2004/0242383 | A1 * | 12/2004 | Karlstrom | A63B 21/0083 482/93 |

(Continued)

FOREIGN PATENT DOCUMENTS

WO 2019199352 A1 10/2019

*Primary Examiner* — Andrew M Kobylarz
(74) *Attorney, Agent, or Firm* — Todd A. Serbin; Maynard Nexsen PC

(57) ABSTRACT

A hang row pendulum apparatus, comprising: a crossbar; and, a main post, connected to the crossbar at a lower end of the main post and having a pivot point on the main post opposite the crossbar.

14 Claims, 10 Drawing Sheets

(56) References Cited

U.S. PATENT DOCUMENTS

| | | | | |
|---|---|---|---|---|
| 2012/0289384 | A1 | 11/2012 | Staten et al. | |
| 2014/0073492 | A1* | 3/2014 | Hunter | A63B 21/0615 482/98 |
| 2014/0080685 | A1 | 3/2014 | Butler | |
| 2015/0083681 | A1 | 3/2015 | Childs | |
| 2015/0352395 | A1 | 12/2015 | Gregory | |
| 2015/0367168 | A1 | 12/2015 | Henniger et al. | |
| 2019/0275363 | A1* | 9/2019 | Jones | A63B 21/0616 |
| 2020/0094096 | A1* | 3/2020 | Sorin | A63B 21/4033 |
| 2020/0114195 | A1 | 4/2020 | Henniger et al. | |
| 2020/0139186 | A1* | 5/2020 | Sorin | A63B 21/0615 |
| 2022/0072361 | A1 | 3/2022 | Henniger et al. | |
| 2022/0323815 | A1* | 10/2022 | Simental | A63B 21/0557 |

* cited by examiner

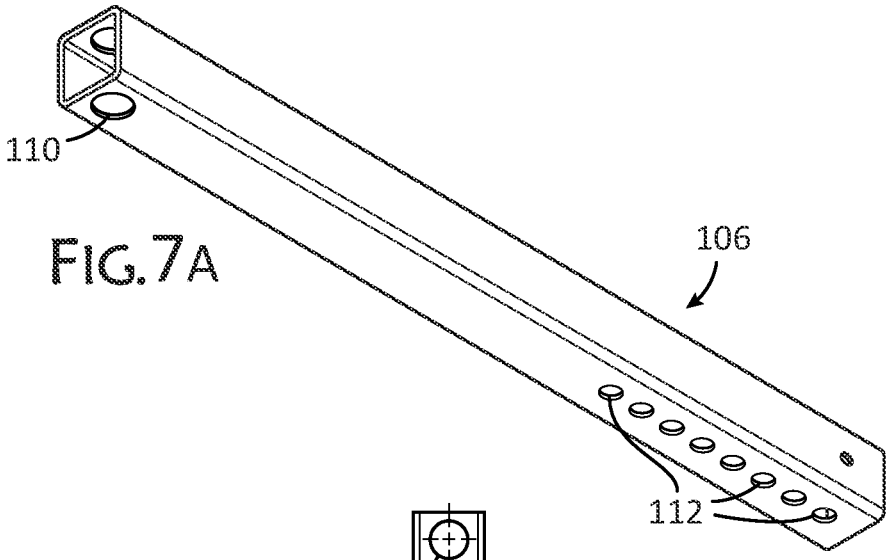
FIG.7A
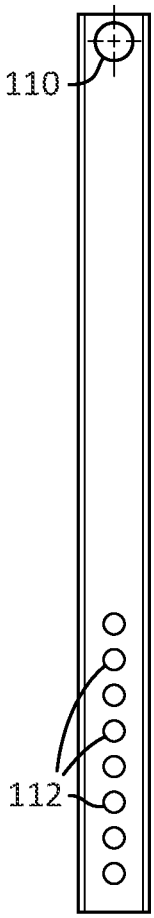
FIG.7B
FIG.7C
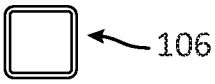

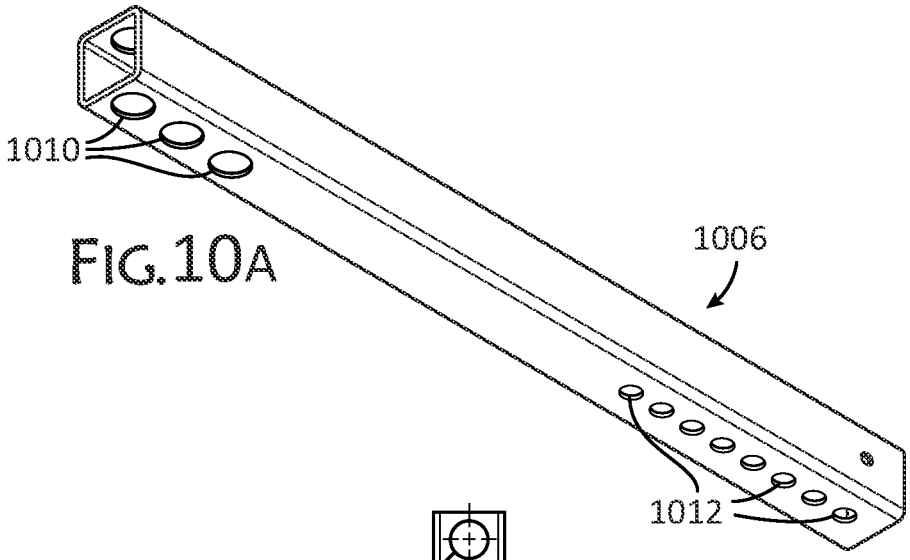
FIG. 10A
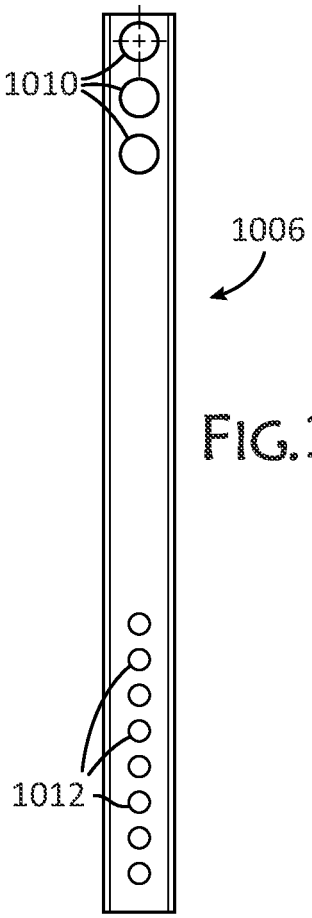
FIG. 10B
FIG. 10C
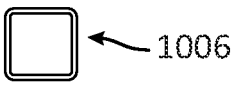

HANG ROW PENDULUM APPARATUS AND METHODS OF USING SAME

RELATED APPLICATION

This application claims the benefit of priority under 35 U.S.C. § 119(e) of U.S. Provisional Patent Application No. 63/173,578 filed Apr. 12, 2021 and under 35 U.S.C. § 120 to U.S. patent application Ser. No. 17/245,189 filed Apr. 30, 2021, the contents of which are incorporated herein by reference in their entireties.

FIELD OF THE INVENTION

The present invention, in some embodiments thereof, relates to the fitness industry and, more particularly, but not exclusively, to a weight rack attachment.

SUMMARY OF THE INVENTION

According to an aspect of some embodiments of the present invention there is provided a hang row pendulum apparatus, comprising: a crossbar; and, a main post, connected to the crossbar at a lower end of the main post and having a pivot point on the main post opposite the crossbar.

In an embodiment of the invention, the hang row pendulum apparatus further comprises at least one weight stop on the crossbar.

In an embodiment of the invention, the at least one weight stop is formed in a J-hook configuration.

In an embodiment of the invention, the hang row pendulum apparatus further comprises a mounting bracket connected the crossbar to the main post.

In an embodiment of the invention, the main post has a plurality of post holes.

In an embodiment of the invention, the main post has a plurality of pivot holes.

In an embodiment of the invention, the mounting bracket has a plurality of bracket holes.

In an embodiment of the invention, the main post is offered as a set of main posts configured in a plurality of sizes.

In an embodiment of the invention, the hang row pendulum apparatus further comprises at least one aperture to attach resistance to the hang row pendulum apparatus.

In an embodiment of the invention, the pivot point defines an axis of rotation of the main post.

In an embodiment of the invention, the hang row pendulum apparatus further comprises at least one handle.

According to an aspect of some embodiments of the present invention there is further provided a method of using a hang row pendulum apparatus, comprising: attaching a main post to a support of a weight rack at a pivot point; grasping a crossbar attached to the main post; pulling the crossbar from a starting position, causing the main post to rotate around the pivot point; and, returning the crossbar to the starting position.

In an embodiment of the invention, the method further comprises raising or lowering a level of the crossbar using a plurality of post holes disposed in the main post.

In an embodiment of the invention, the method further comprises raising or lowering a level of the crossbar using a plurality of pivot holes disposed in the main post.

In an embodiment of the invention, the method further comprises loading resistance on the hang row pendulum apparatus.

According to an aspect of some embodiments of the present invention there is further provided an exercise system, comprising: a support; and, a hang row pendulum apparatus, rotatable attached to the support at the pivot point.

In an embodiment of the invention, the support is connected to a weight rack.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

Figure 8:
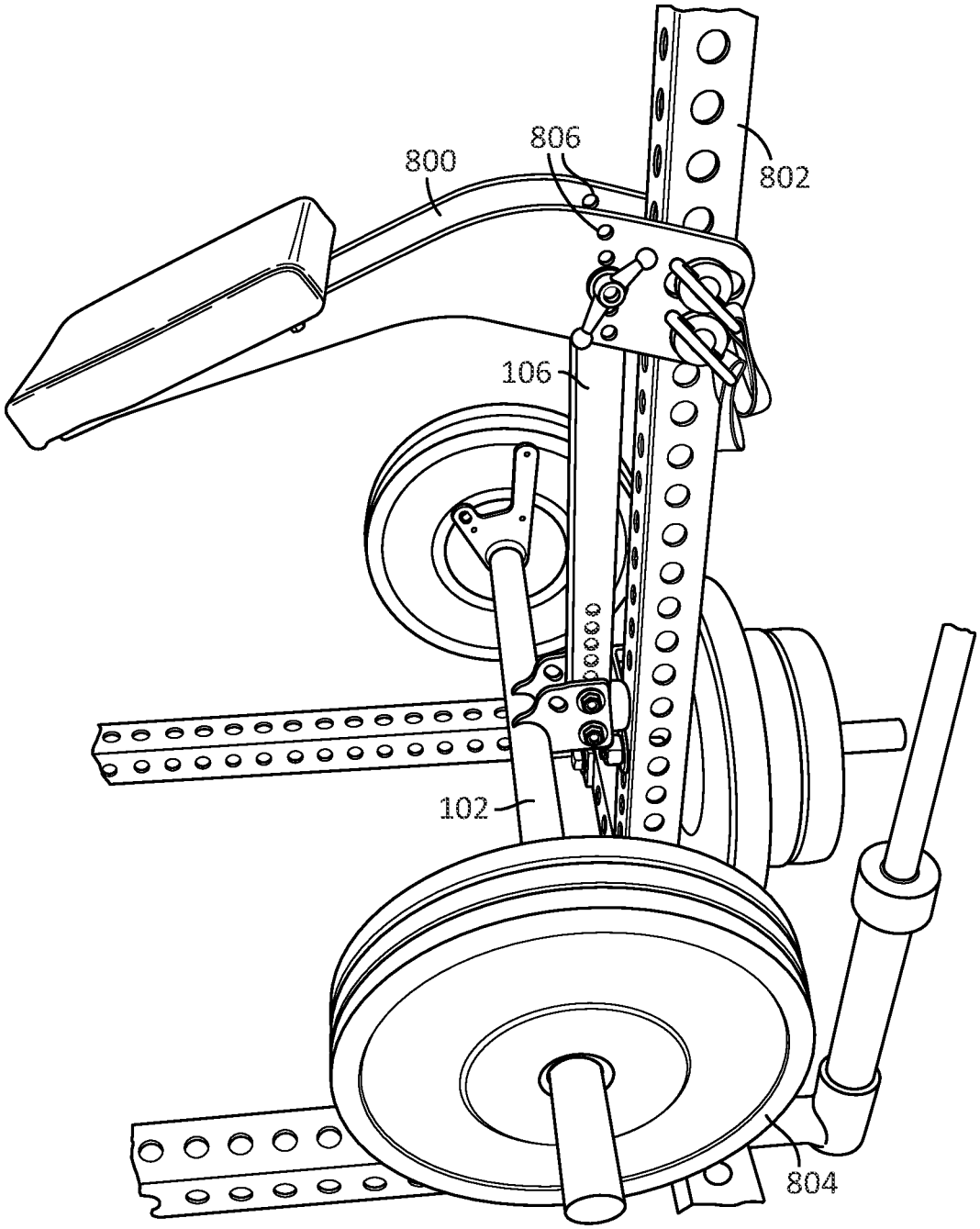
Figure 9:
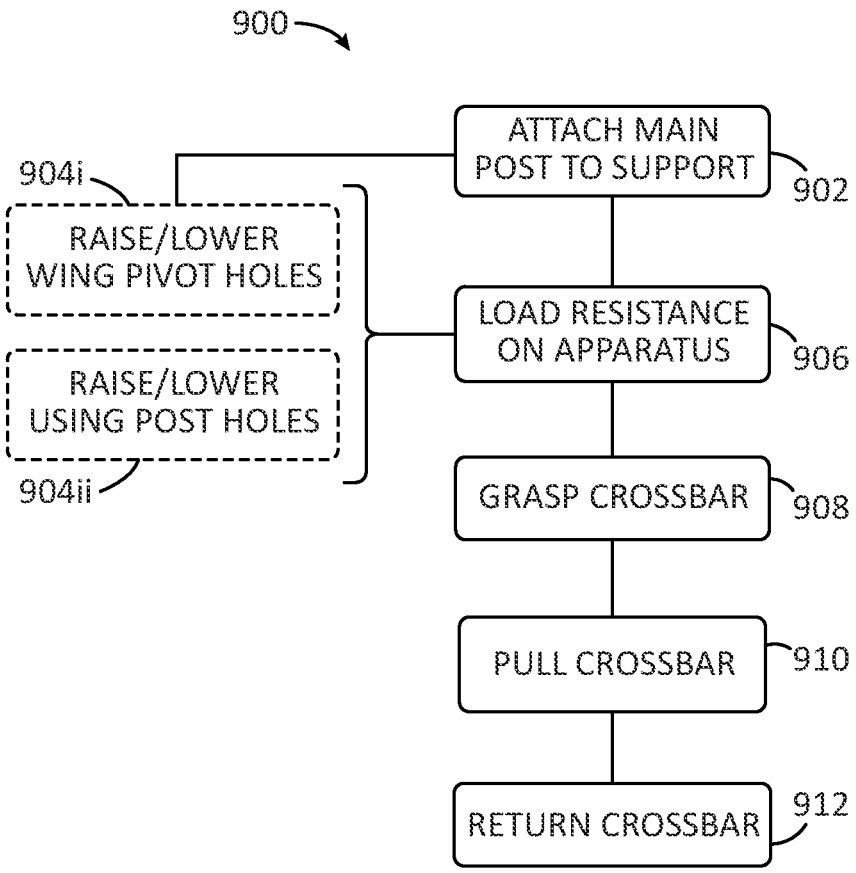

FIGS. 7A, 7B, and 7C are a perspective view, a right/left side view, and a top/bottom view, respectively, of a main post of a hang row pendulum apparatus, in accordance with an exemplary embodiment of the invention;

FIG. 8 is a perspective view of a hang row pendulum apparatus mounted to an adjustable support attachment on a weight rack, in accordance with an exemplary embodiment of the invention; and, FIG. 9 is a flowchart of a method of using of a hang row pendulum apparatus, in accordance with an exemplary embodiment of the invention; and, FIGS. 10A, 10B, and 10C are a perspective view, a right/left side view, and a top/bottom view, respectively, of a main post of a hang row pendulum apparatus with a plurality of pivot holes, in accordance with an exemplary embodiment of the invention.

DESCRIPTION OF SPECIFIC EMBODIMENTS OF THE INVENTION

The present invention, in some embodiments thereof, relates to the fitness industry and, more particularly, but not exclusively, to a weight rack attachment.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

For the purposes of this application, "front" means the side of the hang row pendulum apparatus which is closest to a user facing a weight rack on which the hang row pendulum apparatus is mounted. "Back" or "rear" is the side of the hang row pendulum apparatus opposite the front. The "left" side refers to the user's left from the perspective of the user facing the weight rack and "right" is the side opposite the left. "Up" or "top" and "down" and "bottom" are also with respect to the perspective of the user facing the weight rack.

Figure 1:
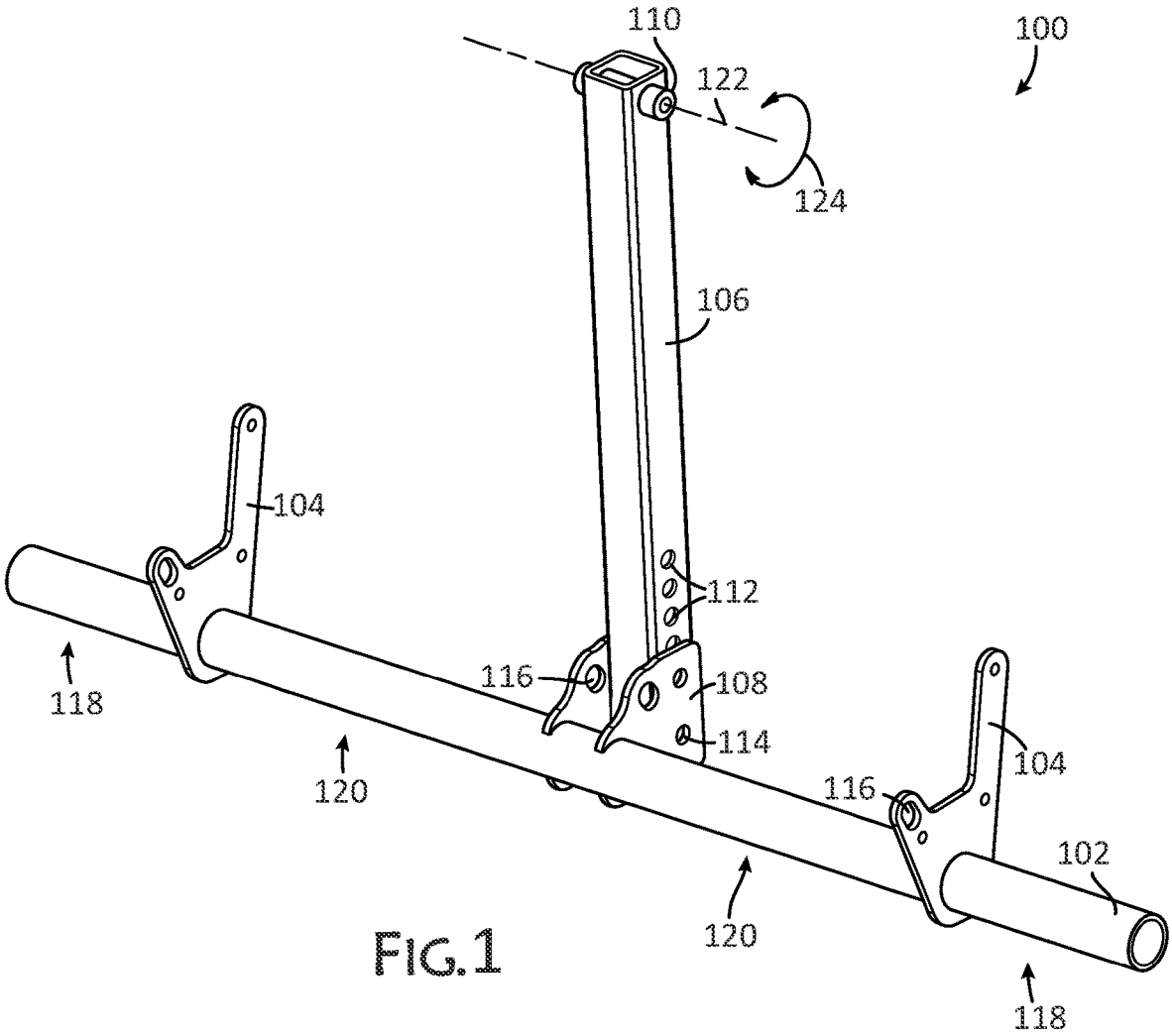
FIG. 1 is a front perspective view of a hang row pendulum apparatus, in accordance with an exemplary embodiment of the invention.

Referring now to the drawings, FIG. 1 is a front perspective view of a hang row pendulum apparatus 100, in accordance with an exemplary embodiment of the invention. Generally, the pendulum apparatus 100 is used to perform weightlifting exercises, and in some embodiments of the invention, hanging row exercises. In an embodiment of the invention, and as will be described in more detail below with respect to FIGS. 8 and 9, a weightlifter/user places his/her chest on a support 800 and grabs a crossbar 102 of the pendulum apparatus to exercise in a pulling or rowing motion where the apparatus 100 rotates about a pivot point 110 (while being directly or indirectly connected to another piece of weightlifting equipment, such as the support 800 or a rack 802). In some embodiments of the invention, an example of support 800 is the adjustable support 100 which is described in U.S. patent application Ser. No. 17/245,189 filed Apr. 30, 2021.

In an embodiment of the invention, opposing ends of the crossbar 102 are used for mounting weights thereon, although depending on the user's needs/desires, the weight of the pendulum apparatus 100 itself could be sufficient for useful exercise. Weight stops 104, formed as J-hooks in this embodiment, are placed on the crossbar 102 for facilitating the even placement of weights on the crossbar 102 and/or to prevent the weights from sliding during exercise. It should be noted that the J-hook configuration of the weight stops 104 provide an additional functionality in that a separate weight bar can be placed on the weight stops 104, resting in the cradle formed by the J-shape of the J-hooks. However, it should be understood that the weight stops 104 do not have to exhibit a J-hook configuration to perform their primary function.

Optionally, the pendulum apparatus 100 is weighted in a different manner than placing weights on each side. For example, by attaching or clipping weights and/or some other form of resistance (including such things as resistance bands) to the crossbar 102, or elsewhere on the apparatus 100. Alternatively, weight is only placed on one side of the crossbar 102 since in some embodiments of the invention, the whole apparatus 100 is moved as one. Optionally, the apparatus 100 is split into two independently rotatable/moveable pendulum swinging devices, for example, the crossbar 102 and a main post 106 each being two discrete and independently movable pieces where the user's right hand and left hand can separately control movement of their respective halves of the apparatus 100.

In an embodiment of the invention, the crossbar 102 is attached to the main post 106 by a mounting bracket 108. The main post 106 is provided with a plurality of post holes 112, corresponding to at least one matching bracket hole 114 wherein when the at least one bracket hole 114 is aligned with a post hole 112, the bracket 108 can be secured to the main post 106, for example using a pin, bolt and/or screw. It is conceived that the plurality of post holes 112 allows the crossbar 102 to be moved up or down relative to the main post 106, and the pivot point 110, depending on how high or low the bracket 108 is reversibly secured to the main post 106 using the plurality of post holes 112 (and in combination with at least one bracket hole 114).

Alternatively, additionally and/or optionally, the pivot point 110 is one of a plurality of pivot points, wherein the main post can be variably adjusted to the support 800 to raise or lower the level of the crossbar 102 (with respect to the user and/or the floor).

Alternatively, the crossbar 102 is permanently affixed to the main post 106, instead of being adjustable and/or removable. Optionally, the apparatus 100 is offered in an array of sizes, for example, where the main post 106 is offered in different lengths to permit a user to buy an apparatus 100 which is of the length, as measured from the pivot point 110 or support 800 to the crossbar 102, preferred for exercise.

In some embodiments, at least one aperture 116 is placed on the apparatus 100, for example to attach additional weights/resistance or other exercise implements to the apparatus 100. These additional items can be clipped, snapped, screwed or otherwise removably attached to the apparatus 100 using the at least one aperture 116.

It should be understood that in the most common scenario of use, weights 804 are placed on the crossbar 102 at regions 118, the user grasps the crossbar 102 at regions 120, and motion 124 is around the axis 122 defined by the pivot point 110.

In some embodiments of the invention, at least one handle (not shown) is placed somewhere on the apparatus 100 (e.g. on the main post 106) for ease of transport and/or for facilitating attaching the apparatus to the support 800 and/or for facilitating adjusting the crossbar 102 height relative to the main post 106, as examples.

Figure 2:
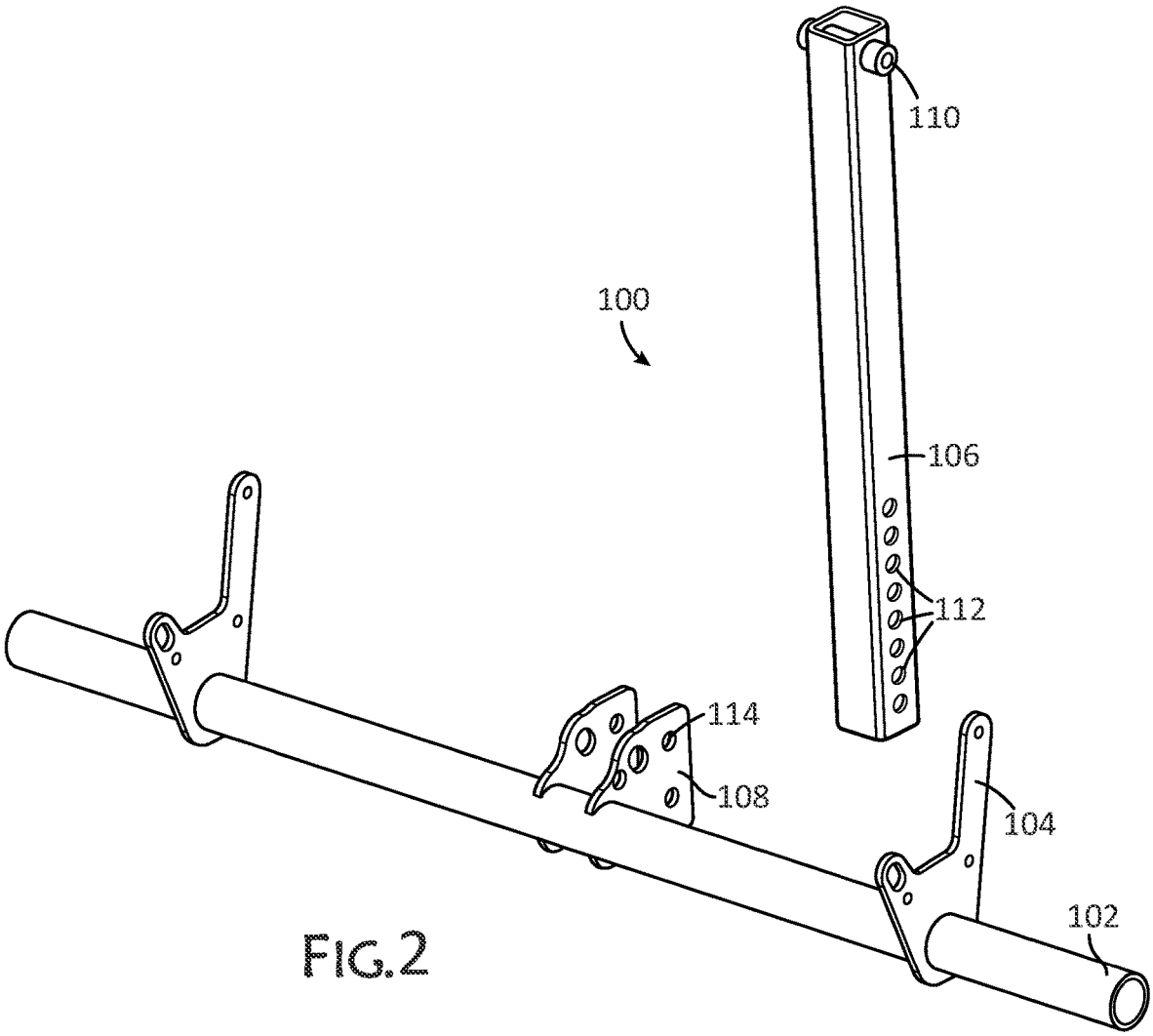
FIG. 2 is an exploded view of a hang row pendulum apparatus, in accordance with an exemplary embodiment of the invention.

FIG. 2 is an exploded view of the hang row pendulum apparatus 100, in accordance with an exemplary embodiment of the invention. The post holes 112 can be seen in more detail in FIG. 2, showing more clearly how the level of the crossbar 102 can be adjusted by reversibly attaching the crossbar 102 to the main post 106 higher or lower using the plurality of post holes 112.

Figure 3:
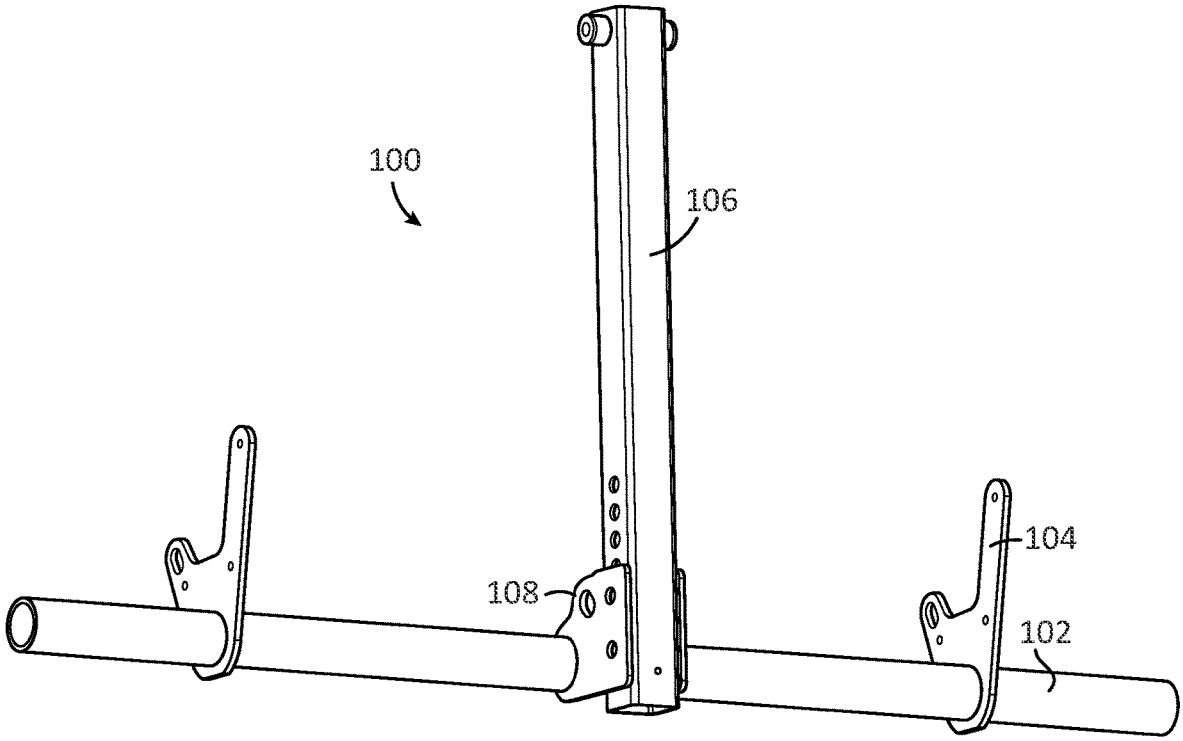
FIG. 3 is a rear perspective view of a hang row pendulum apparatus, in accordance with an exemplary embodiment of the invention.

FIG. 3 is a rear perspective view of the hang row pendulum apparatus 100, in accordance with an exemplary embodiment of the invention.

Figure 4:
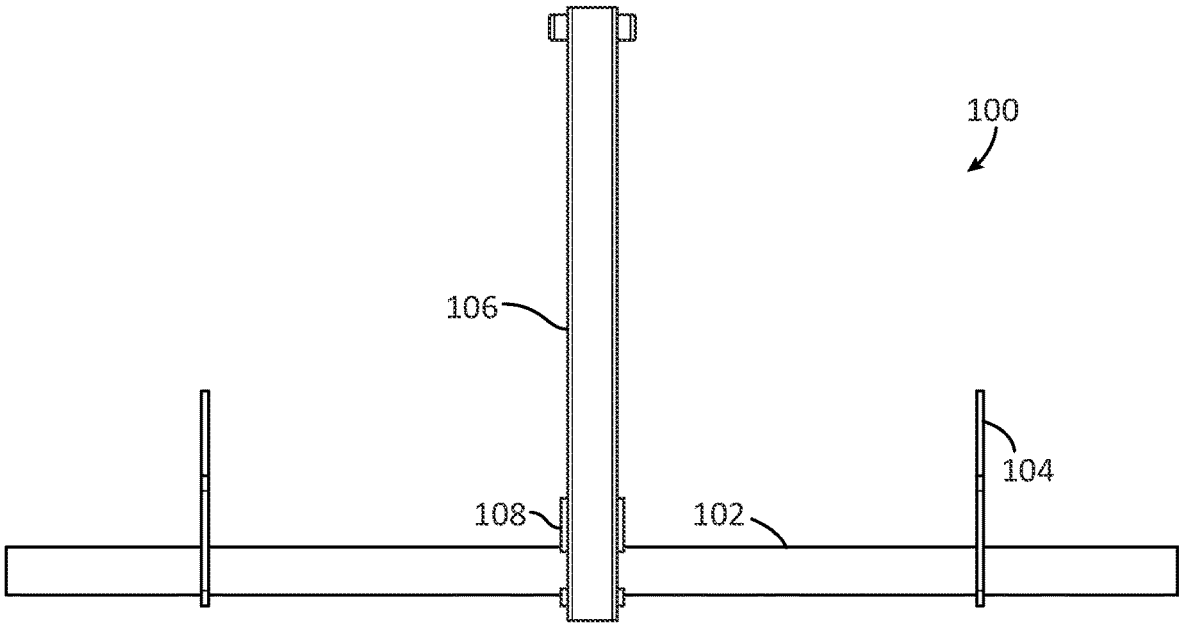
FIG. 4 is a front view of a hang row pendulum apparatus, in accordance with an exemplary embodiment of the invention.
Figure 5:
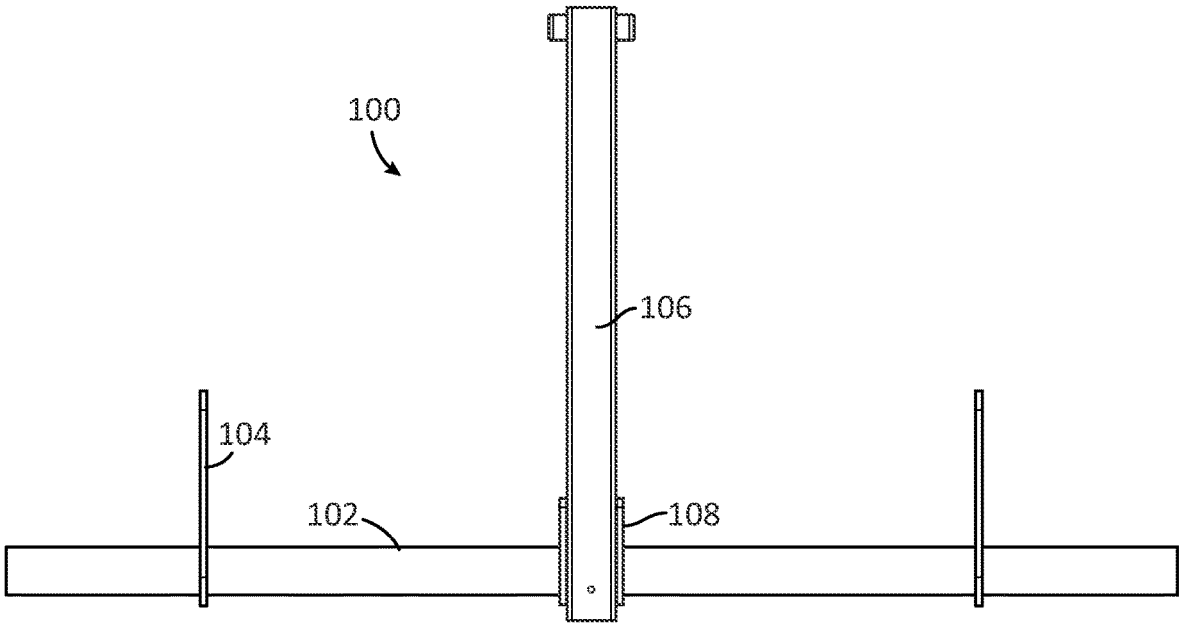
FIG. 5 is a rear view of a hang row pendulum apparatus, in accordance with an exemplary embodiment of the invention.

FIG. 4 is a front view of the hang row pendulum apparatus 100, in accordance with an exemplary embodiment of the invention and FIG. 5 is a rear view of the hang row pendulum apparatus 100, in accordance with an exemplary embodiment of the invention.

Figure 6:
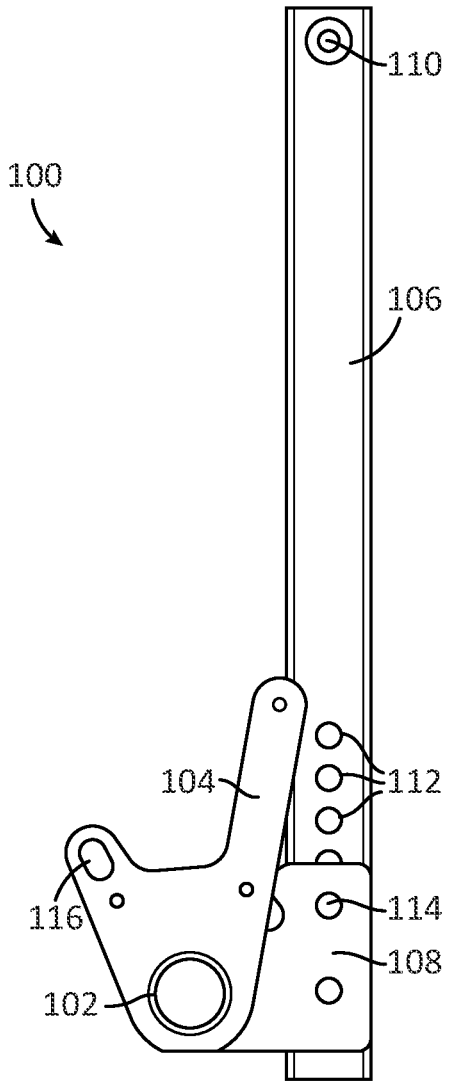
FIG. 6 is a right side view of a hang row pendulum apparatus (where the left side view would be a mirror image), in accordance with an exemplary embodiment of the invention.

FIG. 6 is a right side view of a hang row pendulum apparatus 100 (where the left side view would be a mirror image), in accordance with an exemplary embodiment of the invention.

FIGS. 7A, 7B, and 7C are a perspective view, a right/left side view, and a top/bottom view, respectively, of the main post 106 of the hang row pendulum apparatus 100, in accordance with an exemplary embodiment of the invention.

FIG. 8 is a perspective view of a hang row pendulum apparatus 100 mounted to an adjustable support attachment 800 on a weight rack 802, in accordance with an exemplary embodiment of the invention. In the interests of brevity, the structure displayed in FIG. 8 will be described in conjunction with the flowchart 900 of a method of using of the hang row pendulum apparatus 100 of FIG. 9. It should be understood that the configuration shown in FIG. 8 is by way of example only, and that the apparatus 100 could be directly or indirectly attached to any structure which would enable use of the apparatus 100 in the manner intended, namely a hanging, pendulum-type exercise device.

FIG. 8 shows a perspective of the adjustable support attachment 800, in accordance with an exemplary embodiment of the invention. Generally, the support attachment 800 is designed to adjustably attach to the weight rack 802 and support some or all of the weight of a user while the user is performing exercise with, in and/or in close proximity to the weight rack 802, such as described in more detail in U.S. Provisional Application Ser. No. 63/018,572, the disclosure of which is incorporated herein in its entirety. It is conceived that the support attachment 800 is adjustable in orientation with respect to the weight rack 802 to provide expanded utility and/or customizability to a user of the support attachment 800. By taking advantage of the adjustable nature of the support attachment, a user can perform a wide variety of exercises and/or even just sit, using the support attachment as a seat for exercise or rest.

In an embodiment of the invention, an exercise which can be performed in combination with the support 800 is a hanging row, using the apparatus 100 as described herein and with respect to FIG. 9. In an embodiment of the invention, a main body of the support 800 is provided with at least one pivot hole 806 to which the main post 106 of the apparatus 100 is attached (902) at the pivot point 110. Optionally, a plurality of pivot holes 806 are provided to the support 800 to enable adjustment of where the main post 106 is attached to the support 800, which allows the level of the crossbar 102 to be raised or lowered (904*i*). For example, by using a higher pivot hole 806, the level of the crossbar 102 can be raised. In some embodiments of the invention, the level of the crossbar 102 can be raised or lowered (904*ii*) using the plurality of post holes 112 in combination with the bracket holes 118 as described above. It should be understood that both the post holes 112 and the pivot holes 806 can be used in combination to effectuate adjustment of the level of the crossbar 102 depending on the needs/desires of the user.

In some embodiments of the invention, resistance is loaded (906) on the apparatus 100, for example at least one weight 804 or resistance band (not shown) being attached to and/or placed on the crossbar 102. Optionally, the at least one weight 804 is a standard weight plate (a.k.a. "bumpers") as well-known in the industry.

To commence exercise, in an exemplary embodiment of the invention, a user leans on the support 800 chest down (towards the floor) and grasps (908) the crossbar 102. The user then pulls (910) the crossbar 102 towards him/herself, rotating the apparatus 100 around the pivot point 110 in a rowing motion and away from the rack 802 and returns (912) the crossbar 102 towards the starting position (i.e. towards the at-rest position and towards the rack 802). The user optionally repeats the rowing motion as many times as needed/desired to achieve the desired exercise result.

It is expected that during the life of a patent maturing from this application many relevant weight rack supports will be developed and the scope of the term support is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment, Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A hang row pendulum apparatus, comprising:

a crossbar configured with two, unattached opposing ends and at least one weight stop; and, a main post, connected to the crossbar at a lower end of the main post and having a pivot point on the main post opposite the crossbar, wherein the at least one weight stop is formed in a J-hook configuration.

2. The hang row pendulum apparatus according to claim 1, further comprising a mounting bracket connected the crossbar to the main post.

3. The hang row pendulum apparatus according to claim 2, wherein the mounting bracket has a plurality of bracket holes.

4. An exercise system, comprising:

a support; and, the hang row pendulum apparatus according to claim 1, rotatably attached to the support at the pivot point.

5. The exercise system according to claim 4, wherein the support is connected to a weight rack.

6. The hang row pendulum apparatus according to claim 1, wherein the main post has a plurality of post holes.

7. The hang row pendulum apparatus according to claim 1, wherein the main post has a plurality of pivot holes.

8. The hang row pendulum apparatus according to claim 1, wherein the main post is offered as a set of main posts configured in a plurality of sizes.

9. The hang row pendulum apparatus according to claim 1, further comprising at least one aperture to attach resistance to the hang row pendulum apparatus.

10. The hang row pendulum apparatus according to claim 1, wherein the pivot point defines an axis of rotation of the main post.

11. A method of using a hang row pendulum apparatus, comprising:

attaching a main post to a support of a weight rack at a pivot point;

grasping a crossbar attached to a lower end of the main post, wherein the crossbar is configured with two, unattached opposing ends and at least one weight stop, wherein the at least one weight stop is formed in a J-hook configuration;

pulling the crossbar from a starting position, causing the main post to rotate around the pivot point; and, returning the crossbar to the starting position.

12. The method according to claim 11, further comprising raising or lowering a level of the crossbar using a plurality of post holes disposed in the main post.

13. The method according to claim 11, further comprising raising or lowering a level of the crossbar using a plurality of pivot holes disposed in the main post.

14. The method according to claim 11, further comprising loading resistance on the hang row pendulum apparatus.

* * * * *